US009737755B2

(12) United States Patent
Dalebout

(10) Patent No.: US 9,737,755 B2
(45) **Date of Patent: *Aug. 22, 2017**

(54) EXERCISE DEVICES HAVING DAMPED JOINTS AND RELATED METHODS

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/208,138

(22) Filed: Jul. 12, 2016

(65) Prior Publication Data

US 2016/0317861 A1 Nov. 3, 2016

Related U.S. Application Data

(63) Continuation of application No. 14/068,140, filed on Oct. 31, 2013, now Pat. No. 9,387,387.

(60) Provisional application No. 61/720,893, filed on Oct. 31, 2012.

(51) Int. Cl.

| | |
|---|---|
| ***A63B 22/06*** | (2006.01) |
| ***A63B 71/06*** | (2006.01) |
| ***A63B 21/22*** | (2006.01) |
| ***A63B 22/00*** | (2006.01) |

(52) U.S. Cl.

CPC ..... *A63B 22/0664* (2013.01); *A63B 21/225* (2013.01); *A63B 22/001* (2013.01); *A63B 71/0619* (2013.01); *A63B 2022/067* (2013.01)

(58) Field of Classification Search

USPC ..... 482/51–65

See application file for complete search history.

(56) References Cited

U.S. PATENT DOCUMENTS

| | | | | |
|---|---|---|---|---|
| 3,072,426 | A | 1/1963 | Gilbert | |
| 4,324,501 | A | 4/1982 | Herbenar | |
| 4,499,784 | A | 2/1985 | Shum | |
| 4,928,546 | A | 5/1990 | Walters | |
| 5,568,993 | A | 10/1996 | Potzick | |
| 6,071,031 | A | 6/2000 | Bailey | |
| 6,315,486 | B1 | 11/2001 | Lunz | |
| 6,671,975 | B2 | 1/2004 | Hennessey | |
| 6,769,194 | B2 | 8/2004 | Hennessey | |
| 7,290,760 | B1 | 11/2007 | Lindsay | |
| 7,475,613 | B2 | 1/2009 | Bailey | |
| 7,604,573 | B2 | 10/2009 | Dalebout et al. | |
| 8,449,620 | B2 | 5/2013 | Hakansson | |
| 9,015,952 | B2 | 4/2015 | Magosaki | |
| 9,387,387 | B2 * | 7/2016 | Dalebout ..... | A63B 71/0619 |

* cited by examiner

*Primary Examiner* — Stephen R Crow

(74) *Attorney, Agent, or Firm* — Holland & Hart LLP

(57) ABSTRACT

An exercise device may comprise at least one joint. The at least one joint may comprise at least one first surface positioned adjacent to at least one second surface, the at least one second surface movable relative to the at least one first surface at at least one interface. A damping grease having a dynamic viscosity greater than about 100 Pascal seconds at standard temperature and pressure may be positioned at the at least one interface between the at least one first surface and the at least one second surface of the at least one joint.

20 Claims, 5 Drawing Sheets

EXERCISE DEVICES HAVING DAMPED JOINTS AND RELATED METHODS

CROSS-REFERENCE TO RELATED APPLICATIONS

This application is a continuation of U.S. application Ser. No. 14/068,140, filed on Oct. 31, 2013 which claims priority to U.S. Provisional Patent application 61/720,893 filed on Oct. 31, 2012.

TECHNICAL FIELD

The present disclosure relates to exercise equipment. More specifically, the present disclosure relates to exercise equipment having damped joints and related methods.

BACKGROUND

Exercise equipment that provides elliptical foot movement, commonly called "ellipticals," have become very popular. Ellipticals allow a user to simulate walking or running motion for exercise with less impact to the user's body and joints when compared to exercising on a treadmill. Additionally, ellipticals may be less intimidating to users than other equipment, such as treadmills, as the speed of the exercising movement is controlled by the user, rather than an electric motor. Accordingly, there may be less risk of injury when exercising on an elliptical, when compared to exercising on a treadmill.

As an elliptical provides an elliptical motion, the motion of the foot pads of an elliptical includes an upward and downward component. Additionally, the foot pads may freely move along the elliptical path, even when the elliptical is not powered on, as the user provides the energy to move the foot pads, rather than an electric motor. Accordingly, when a user steps on to an elliptical the foot pad may move suddenly, especially if the foot pad is not located at the lowest position.

The sudden movement of the foot pad may cause the user to lose their balance and fall and/or become injured. Additionally, the linkages of the elliptical may cause the sudden movement of one foot pad to swiftly move the other foot pad and the swing arms of the elliptical, which may further off-balance a user and potentially cause an impact between the user and a moving component of the elliptical. For example, a user may be hit by a handle of a swing arm that moves suddenly as the user steps onto a foot pad of an elliptical.

In view of the foregoing, it would be desirable to have improved exercise devices and related methods to address the shortcomings in the art.

SUMMARY

In one aspect of the present disclosure, an exercise device may comprise at least one joint comprising at least one first surface positioned adjacent to at least one second surface, the at least one second surface movable relative to the at least one first surface at at least one interface.

In another aspect of the present disclosure, which may be combined with other aspects, a damping grease having a dynamic viscosity greater than about 100 Pascal seconds at standard temperature and pressure may be positioned at the at least one interface between the at least one first surface and the at least one second surface of the at least one joint.

In another aspect of the present disclosure, which may be combined with other aspects, the damping grease may comprise a synthetic hydrocarbon fluid base.

In another aspect of the present disclosure, which may be combined with other aspects, the damping grease may comprise silica.

In another aspect of the present disclosure, which may be combined with other aspects, the damping grease may have a dynamic viscosity of about 220 Pascal seconds at standard temperature and pressure.

In another aspect of the present disclosure, which may be combined with other aspects, the at least one joint may be configured to bear at least a portion of a user's weight while exercising on the exercise device.

In another aspect of the present disclosure, which may be combined with other aspects, the exercise device may further comprise a frame.

In another aspect of the present disclosure, which may be combined with other aspects, the exercise device may further comprise a first foot support member comprising a central region mechanically constrained to follow an ovoid path, and a second foot support member comprising a central region mechanically constrained to follow an ovoid path.

In another aspect of the present disclosure, which may be combined with other aspects, the exercise device may further comprise a first swing arm coupled to a first side of an upper portion of the frame by a first hinge joint, a first end of the first swing arm comprising a handle and a second end of the first swing arm coupled to the first foot support member via a second hinge joint.

In another aspect of the present disclosure, which may be combined with other aspects, the exercise device may further comprise a second swing arm coupled to a second side of the upper portion of the frame by a third hinge joint, a first end of the second swing arm comprising a handle and a second end of the second swing arm coupled to the second foot support member via a fourth hinge joint.

In another aspect of the present disclosure, which may be combined with other aspects, the at least one joint may comprise the first hinge joint and the third hinge joint.

In another aspect of the present disclosure, which may be combined with other aspects, the at least one joint may further comprise the second hinge joint and the fourth hinge joint.

In another aspect of the present disclosure, which may be combined with other aspects, the exercise device may further comprise a drive assembly comprising a rotating member, a first crank arm extending from a first side of the rotating member, and a second crank arm extending from a second side of the rotating member.

In another aspect of the present disclosure, which may be combined with other aspects, the first crank arm may be coupled to the first foot support member by a fifth hinge joint, and the second crank arm may be coupled to the second foot support member by a sixth hinge joint.

In another aspect of the present disclosure, which may be combined with other aspects, the at least one joint may further comprise the fifth hinge joint and the sixth hinge joint.

In another aspect of the present disclosure, which may be combined with other aspects, the at least one interface between the at least one first surface and the at least one second surface of the at least one joint may be shaped as a side surface of a cylinder.

In an additional aspect of the present disclosure, a method of manufacturing an exercise device may comprise positioning at least one first surface adjacent to at least one second surface to form at least one joint.

In another aspect of the present disclosure, which may be combined with other aspects, the method of manufacturing an exercise device may further comprise positioning a damping grease having a dynamic viscosity greater than about 100 Pascal seconds at standard temperature and pressure at the at least one interface between the at least one first surface and the at least one second surface of the at least one joint.

In another aspect of the present disclosure, which may be combined with other aspects, positioning the damping grease may comprise positioning a damping grease comprising a synthetic hydrocarbon fluid base.

In another aspect of the present disclosure, which may be combined with other aspects, positioning the damping grease may comprise positioning a damping grease comprising silica.

In another aspect of the present disclosure, which may be combined with other aspects, positioning the damping grease may comprise positioning a damping grease having a dynamic viscosity of about 220 Pascal seconds at standard temperature and pressure.

In another aspect of the present disclosure, which may be combined with other aspects, positioning the at least one first surface adjacent to the at least one second surface to form the at least one joint may comprise positioning the at least one first surface adjacent to the at least one second surface to form at least one joint configured to bear at least a portion of a user's weight while exercising on the exercise device.

In another aspect of the present disclosure, which may be combined with other aspects, the method of manufacturing an exercise device may further comprise providing a frame.

In another aspect of the present disclosure, which may be combined with other aspects, the method of manufacturing an exercise device may further comprise providing a first foot support member comprising a central region mechanically constrained to follow an ovoid path, and a second foot support member comprising a central region mechanically constrained to follow an ovoid path.

In another aspect of the present disclosure, which may be combined with other aspects, the method of manufacturing an exercise device may further comprise coupling a first swing arm having a first end comprising a handle to a first side of an upper portion of the frame by a first hinge joint.

In another aspect of the present disclosure, which may be combined with other aspects, the method of manufacturing an exercise device may further comprise coupling a second end of the first swing arm to the first foot support member by a second hinge joint.

In another aspect of the present disclosure, which may be combined with other aspects, the method of manufacturing an exercise device may further comprise coupling a second swing arm having a first end comprising a handle to a second side of an upper portion of the frame by a third hinge joint.

In another aspect of the present disclosure, which may be combined with other aspects, the method of manufacturing an exercise device may further comprise coupling a second end of the second swing arm to the second foot support member by a fourth hinge joint.

In another aspect of the present disclosure, which may be combined with other aspects, the method of manufacturing an exercise device may comprise positioning the damping grease at an interface of the first hinge joint and the third hinge joint.

In another aspect of the present disclosure, which may be combined with other aspects, the method of manufacturing an exercise device may further comprise positioning the damping grease at an interface of the second hinge joint and the fourth hinge joint.

In another aspect of the present disclosure, which may be combined with other aspects, the method of manufacturing an exercise device may further comprise providing a drive assembly comprising a rotating member, a first crank arm extending from a first side of the rotating member, and a second crank arm extending from a second side of the rotating member.

In another aspect of the present disclosure, which may be combined with other aspects, the method of manufacturing an exercise device may further comprise coupling the first foot support member to the first crank arm by a fifth hinge joint.

In another aspect of the present disclosure, which may be combined with other aspects, the method of manufacturing an exercise device may further comprise coupling the second foot support member to the second crank arm by a sixth hinge joint.

In another aspect of the present disclosure, which may be combined with other aspects, the method of manufacturing an exercise device may further comprise positioning the damping grease at an interface of the fifth hinge joint and the sixth hinge joint.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
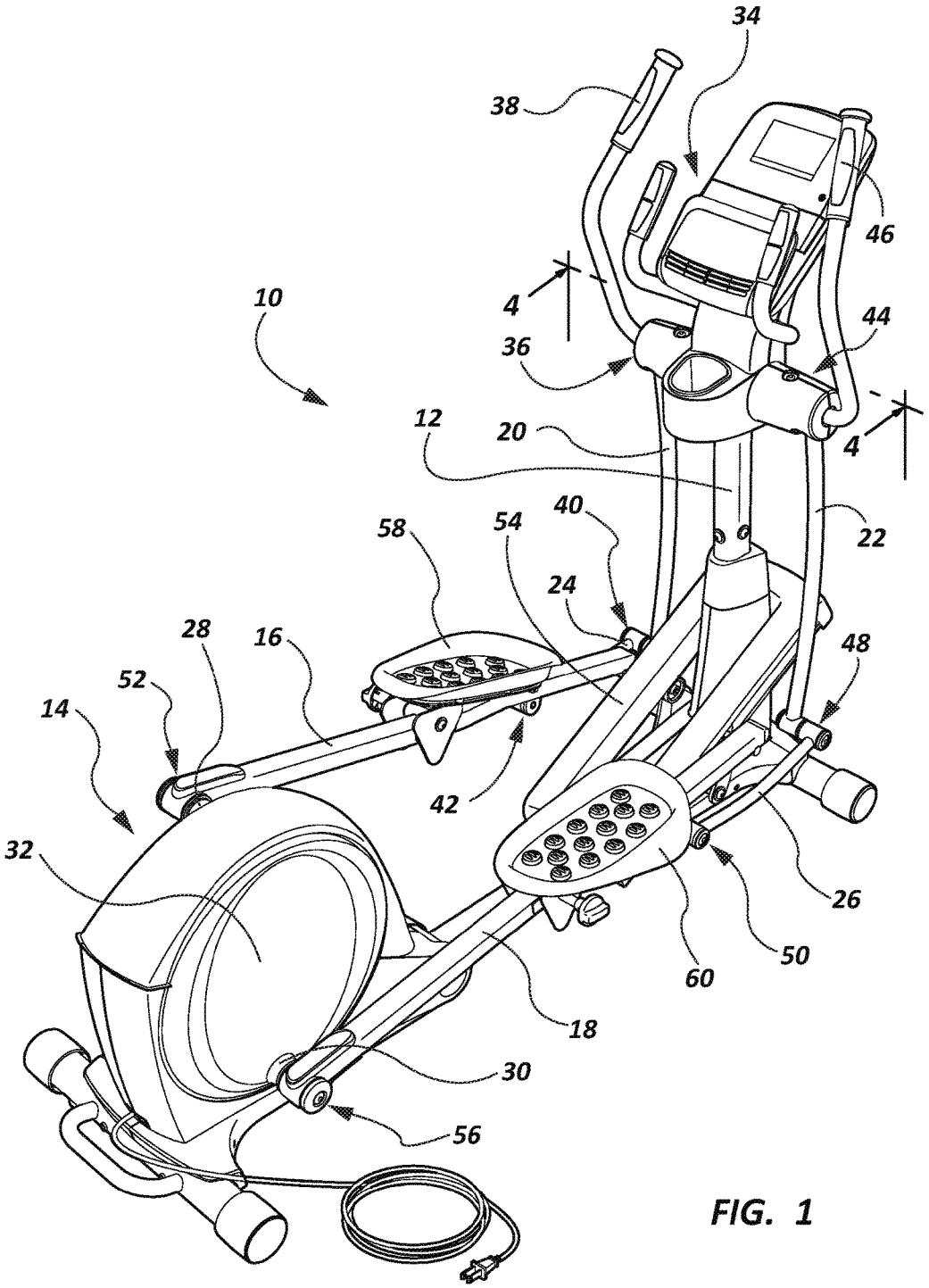
FIG. 1 is an isometric view of an exercise machine including damped joints according to an embodiment of the present disclosure.

In one embodiment, as shown in FIG. 1, an exercise device 10 may comprise a frame 12, a drive assembly 14, foot support members 16 and 18, swing arms 20 and 22, and link arms 24 and 26. The drive assembly 14 may be mounted at a rear portion of the frame 12. The drive assembly 14 may include a first crank arm 26 located on a first side of the drive assembly 14, and a second crank arm 28 located on an opposing, second side of the drive assembly 14. The first and second crank arms 28 and 30 may be coupled to a central rotating member 32, and the drive assembly 14 may provide selectable resistance to the rotation of the central rotating member 32 by the first and second crank arms 28 and 30.

A console 34 may be positioned at an upper end of the frame 12, and the first swing arm 20 may be rotatably coupled to a first side of an upper portion of the frame 14 by a first hinge joint 36 located below the console 34. An upper end of the first swing arm 20 may extend above the first hinge joint 36 and may comprise a first handle 38 extending above the console 34. A lower end of the first swing arm 20 may extend below the first hinge joint 36 and may be rotatably attached to a first end of a first link arm 24 via a second hinge joint 40. In turn, a second end of the first link arm 24 may be rotatably attached to the first foot support member 16 via a third hinge joint 42.

In a similar manner, the second swing arm 22 may be rotatably coupled to a second side of the upper portion of the frame 14 by a fourth hinge joint 44. An upper end of the second swing arm 22 may extend above the fourth hinge joint 44 and may comprise a second handle 46. A lower end of the second swing arm 22 may extend below the fourth hinge joint 44 and may be rotatably attached to a first end of a second link arm 26 via a fifth hinge joint 48. In turn, a second end of the second link arm 26 may be rotatably attached to the second foot support member 18 via a sixth hinge joint 50.

A back end of the first foot support member 16 may be rotatably coupled to the first crank arm 28 by a seventh hinge joint 52. Accordingly, the seventh hinge joint 52 at the back end of the first foot support member 16 may be constrained to movement along a circular path defined by the rotation of the first crank arm 28 about the central rotating member 32 of the drive assembly 14. Meanwhile, the front end of the first foot support member 16 may be constrained to a movement along an adjustable ramp 54, which may define a substantially linear path.

In a similar manner, a back end of the second foot support member 18 may be rotatably coupled to the second crank arm 30 by an eighth hinge joint 56. Accordingly, the eighth hinge joint 56 at the back end of the second foot support member 18 may be constrained to movement along a circular path, and the front end of the second foot support member 18 may be constrained to a movement along a linear path defined by the adjustable ramp 54.

A first foot pad 58 may be coupled to a middle portion of the first foot support member 16, and a second foot pad 60 may be coupled to a middle portion of the second foot support member 18. As the front ends of the first and second foot support members 16 and 18 are constrained to movement along a linear path, and the back ends of the first and second foot support members 16 and 18 are constrained to movement along a circular path, the middle portion of each foot support member 16 and 18 may be constrained to movement along an ovoid path (e.g., a path that is non-circular, having the shape of an egg, an oval, or an ellipse).

Each of the hinge joints 36, 40, 42, 44, 58, 50, 52, 56 may include a first surface of a first component adjacent a second surface of a second component. The first surface and the second surface may define an interface therebetween, and the second surface may be movable relative to the first surface at the interface. At least one of the hinge joints 36, 40, 42, 44, 58, 50, 52, 56 may include a damping grease 62 (see FIG. 5) positioned therein. For example, the first and fourth hinge joints 36 and 44 coupling the swing arms 20 and 22 to the frame 12 may each include a damping grease 62 positioned therein.

Figure 2:
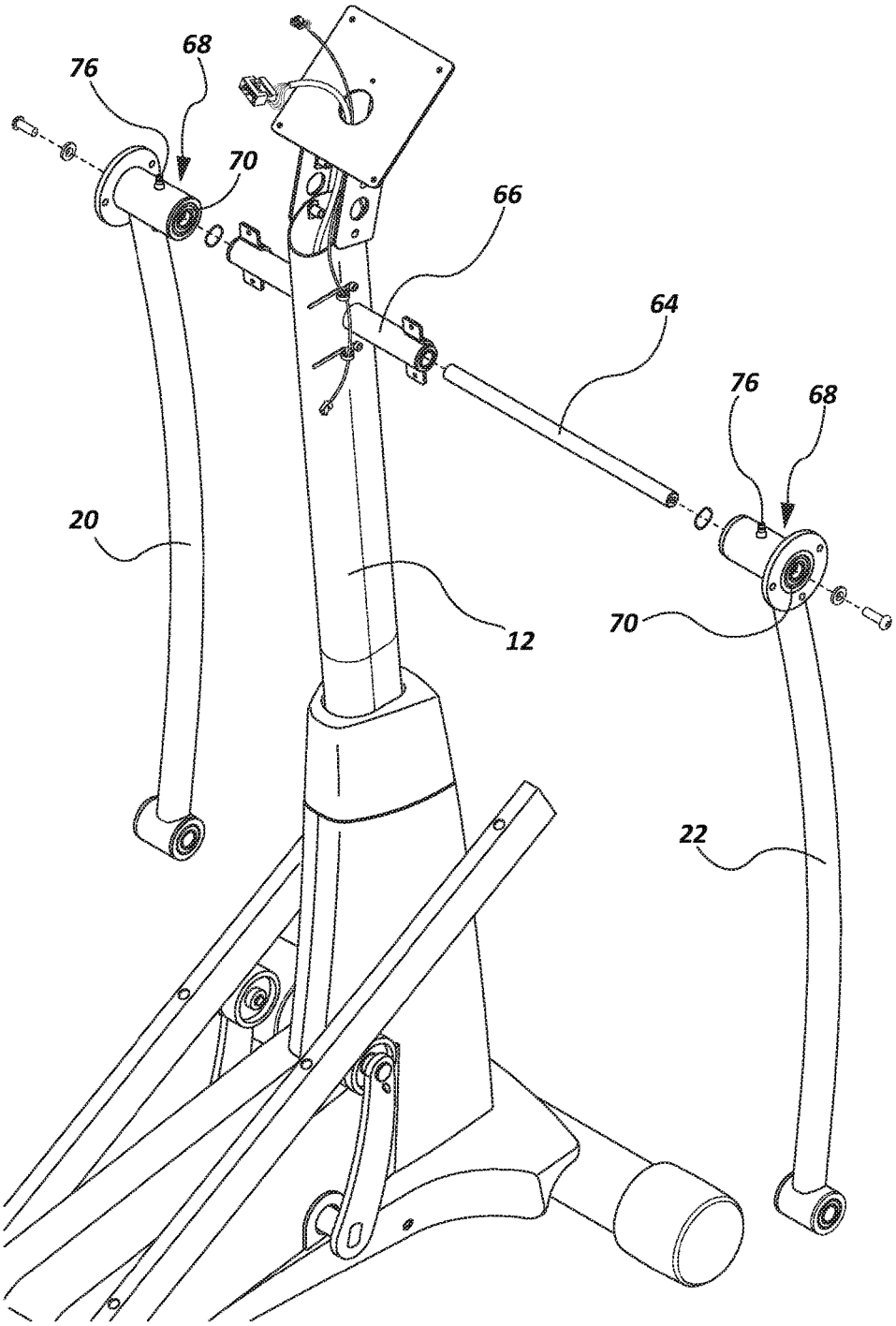
FIG. 2 is an exploded view of a joint assembly of the exercise machine of FIG. 1.
Figure 3:
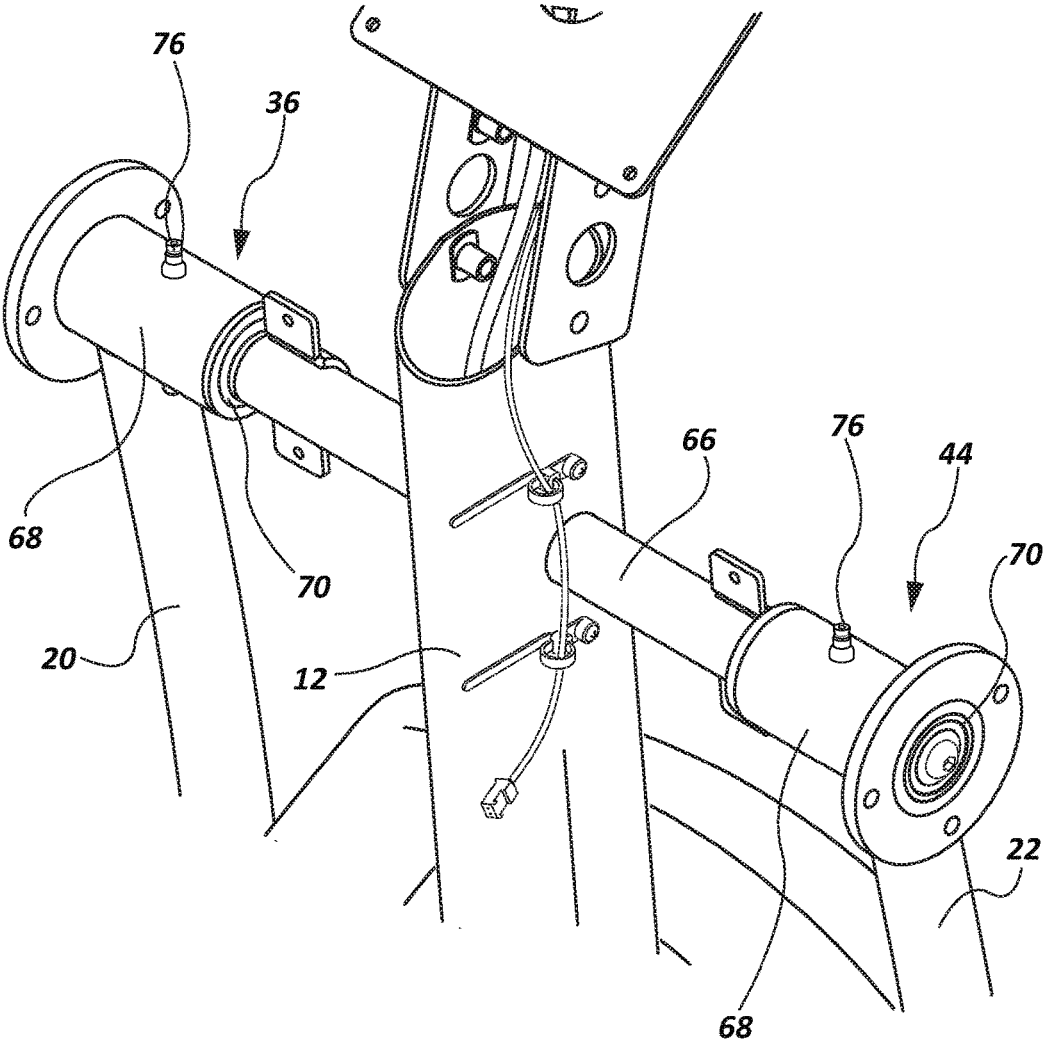
FIG. 3 is a detail view of the joint assembly of FIG. 2.

As shown in FIG. 2, the first and fourth hinge joints 36 and 44, coupling the swing arms 20 and 22 to the frame 12, may comprise a pin 64 extending through a support tube 66 coupled to the frame 12.

Figure 4:
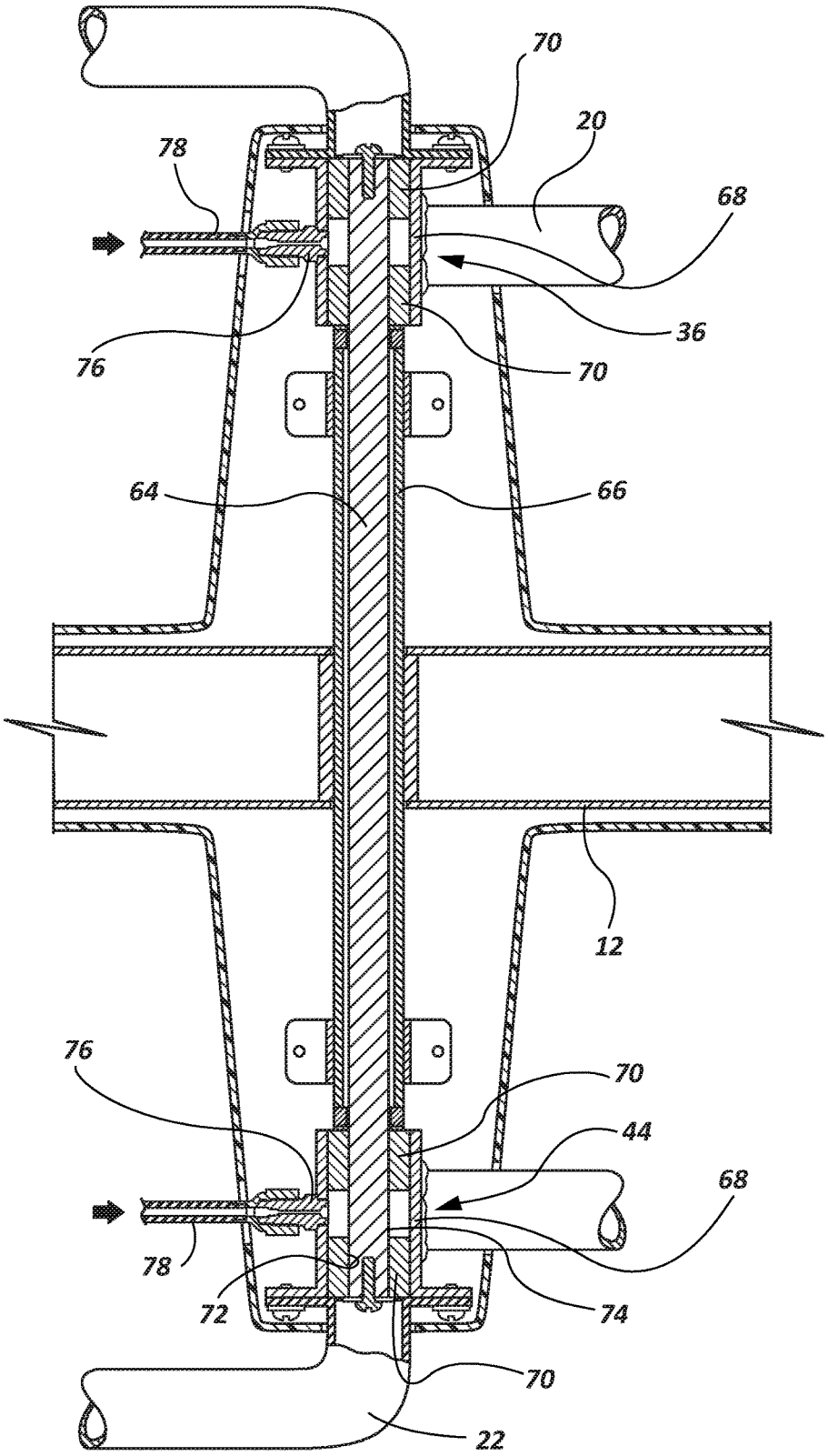
FIG. 4 is a cross-sectional view of the joint assembly of FIG. 2 before the insertion of grease into the joint assembly.
Figure 5:
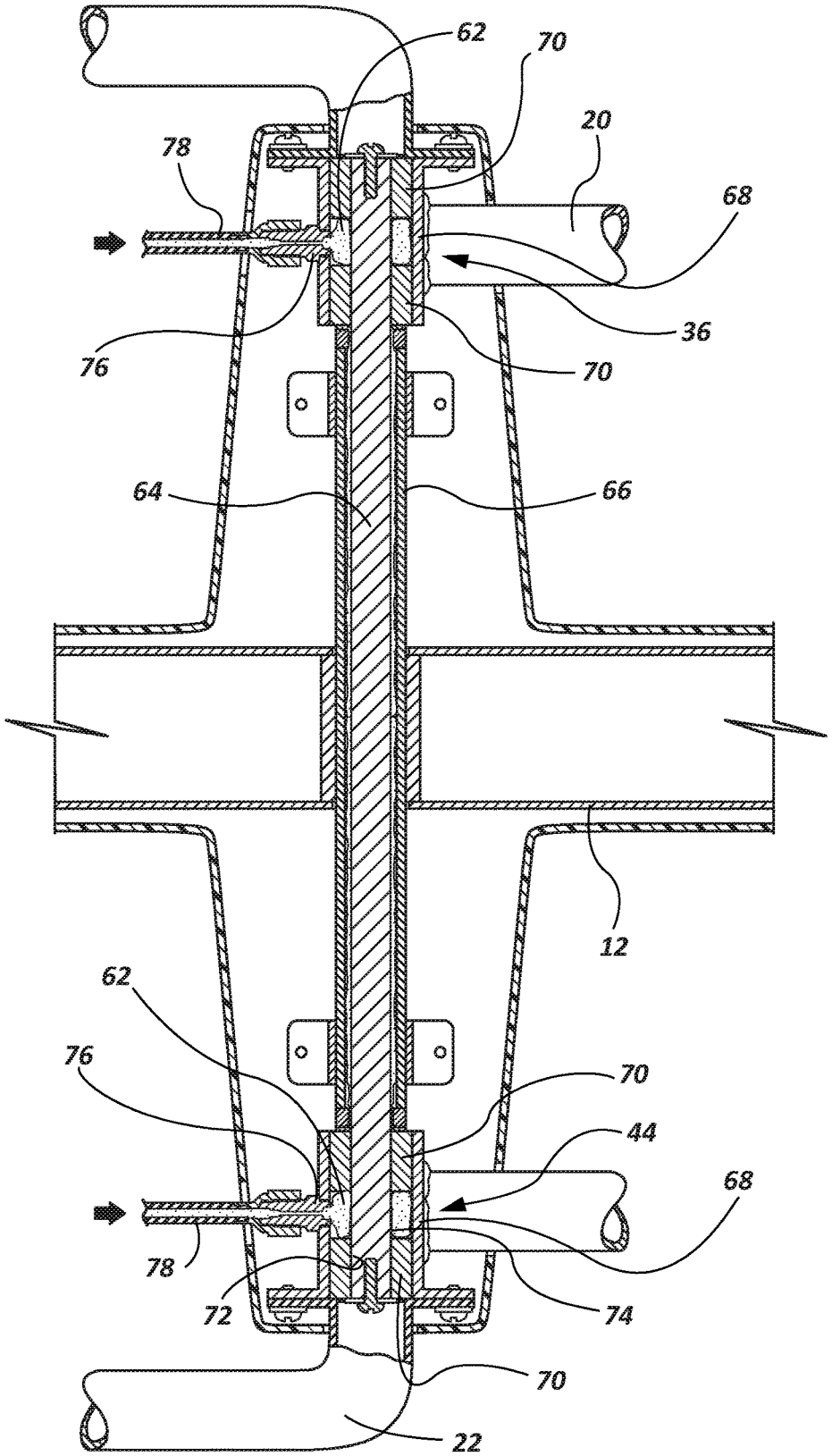
FIG. 5 is a cross-sectional view of the joint assembly of FIG. 2 after the insertion of grease into the joint assembly.

As shown in FIGS. 4 and 5, each of the first and second swing arms 20 and 22 may include a barrel portion 68 including bushings 70 positioned therein. The bushings 70 may be positioned on the pin 64, an inner surface 72 of the bushings 70 and an outer surface 74 of the pin 64 may define an interface therebetween where the bushings 70 may rotate relative to the pin 64.

In some embodiments, the barrel portion 68 of the hinge joint 36, 44 may include a grease fitting 76 located thereon to facilitate the attachment of a grease gun 78 for the insertion of the damping grease 62 into the interface of hinge joint 36, 44, as shown in FIGS. 4 and 5. In further embodiments, a hinge joint may not include a grease fitting and damping grease 62 may be packed into the interface of the hinge joint before the hinge joint is fully assembled.

The damping grease 62 positioned at the interface of at least one of the hinge joints 36, 40, 42, 44, 58, 50, 52, 56 may be a grease having a relatively high viscosity. For example, the damping grease 62 may have a dynamic viscosity greater than 100 Pascal seconds (Pa·s) at standard temperature and pressure (STP) (i.e., greater than about one kilopoise at STP). In some embodiments, the damping grease 62 may comprise a synthetic hydrocarbon fluid base and a silica thickener and may have a dynamic viscosity of about 220 Pa·s at STP (i.e., about 2.2. kilopoise at STP). For example, damping grease sold under the tradename ROCOL® KILOPOISE 0868S, available from ROCOL of Leeds, England, may be a suitable damping grease 62.

The properties of the damping grease 62 positioned at the interface of at least one hinge joint 36, 40, 42, 44, 58, 50, 52, 56 of the exercise device 10 between a first component (e.g., a bushing 70) and a second component (e.g., a pin 64) may resist the sudden movement (i.e., a relatively fast acceleration) of the first component of the at least one hinge joint 36, 40, 42, 44, 58, 50, 52, 56 relative to the second component of the at least one hinge joint 36, 40, 42, 44, 58, 50, 52, 56. Accordingly, when a user steps onto a foot pad 58, 60 of the exercise device 10, the damping grease 62 may prevent the foot pads 58 and 60, and other moving components such as the swing arms 20 and 22, from suddenly moving in response to the force applied by the user's foot. Rather, the foot pad 58, 60 may provide some resistance to the user's foot and the moving components may start to move relatively slowly. This may provide sufficient time for a user to gain their balance and react to the movement of the foot pads 58 and 60 and swing arms 20 and 22 as the user steps onto the exercise device 10.

Although the damping grease 62 may provide resistance to relatively fast acceleration of the foot pads 58 and 60 and swing arms 20 and 22, the damping grease may provide relatively low resistance to movement of the foot pads 58 and 60 and swing arms 20 and 22 that is associated with relatively slow acceleration, such as during normal exercise on the exercise device 10.

INDUSTRIAL APPLICABILITY

Exercise equipment that provides elliptical foot movement, commonly called "elliptical," have become very popular. Ellipticals allow a user to simulate walking or running motion for exercise with less impact to the user's body and joints when compared to exercising on a treadmill. Additionally, ellipticals may be less intimidating to users than other equipment, such as treadmills, as the speed of the exercising movement is controlled by the user, rather than an electric motor. Accordingly, there may be less risk of injury when exercising on an elliptical, when compared to exercising on a treadmill.

As an elliptical provides an elliptical motion, the motion of the foot pads of an elliptical includes an upward and downward component. Additionally, the foot pads may freely move along the elliptical path, even when the elliptical is not powered on, as the user provides the energy to move the foot pads, rather than an electric motor. Accordingly, when a user steps on to an elliptical the foot pad may move suddenly, especially if the foot pad is not located at the lowest position.

The sudden movement may cause the user to lose their balance and fall and/or become injured. Additionally, the linkages of the elliptical may cause the sudden movement of one foot pad to swiftly move the other foot pad and the swing arms of the elliptical, which may further off-balance a user and potentially cause an impact between the user and a moving component of the elliptical. For example, a user may be hit by a handle of a swing arm that moves suddenly as the user steps onto a foot pad of an elliptical.

In view of the foregoing, it would be desirable to have improved exercise devices and related methods to address the shortcomings in the art.

In one embodiment of the present disclosure, an exercise device may comprise a frame, a drive assembly, foot support members, swing arms, and link arms. The drive assembly may be mounted at a rear portion of the frame. The drive assembly may include a first crank arm located on a first side of the drive assembly, and a second crank arm located on an opposing, second side of the drive assembly. The first and second crank arms may be coupled to a central rotating member, and the drive assembly may provide selectable resistance to the rotation of the central rotating member by the first and second crank arms.

A console may be positioned at an upper end of the frame, and the first swing arm may be rotatably coupled to a first side of an upper portion of the frame by a first hinge joint located below the console. An upper end of the first swing arm may extend above the first hinge joint and may comprise a first handle extending above the console. A lower end of the first swing arm may extend below the first hinge joint and may be rotatably attached to a first end of a first link arm via a hinge joint. In turn, a second end of the first link arm may be rotatably attached to the first foot support member via a hinge joint.

In a similar manner, the second swing arm may be rotatably coupled to a second side of the upper portion of the frame by a second hinge joint. An upper end of the second swing arm may extend above the second hinge joint and may comprise a second handle. A lower end of the second swing arm may extend below the second hinge joint and may be rotatably attached to a first end of a second link arm via a hinge joint. In turn, a second end of the second link arm may be rotatably attached to the second foot support member via a hinge joint.

A back end of the first foot support member may be rotatably coupled to the first crank arm by a hinge joint. Accordingly, the hinge joint at the back end of the first foot support member may be constrained to movement along a circular path defined by the rotation of the first crank arm about the central rotating member of the drive assembly. Meanwhile, the front end of the first foot support member may be constrained to a movement along an adjustable ramp, which may define a substantially linear path.

In a similar manner, a back end of the second foot support member may be rotatably coupled to the second crank arm by a hinge joint. Accordingly, the hinge joint at the back end of the second foot support member may be constrained to movement along a circular path, and the front end of the first foot support member may be constrained to a movement along a linear path defined by the adjustable ramp.

A first foot pad may be coupled to a middle portion of the first foot support member, and a second foot pad may be coupled to a middle portion of the second foot support member. As the front ends of the first and second foot support members are constrained to movement along a linear path, and the back ends of the first and second foot support members are constrained to movement along a circular path, the middle portion of each foot support member may be constrained to movement along an ovoid path (e.g., a path that is non-circular, having the shape of an egg, an oval, or an ellipse).

Each of the hinge joints may include a first surface of a first component adjacent a second surface of a second component. The first surface and the second surface may define an interface therebetween, and the second surface may be movable relative to the first surface at the interface.

At least one of the hinge joints may include a damping grease positioned therein. For example, the first and second hinge joints coupling the swing arms to the frame may each include a damping grease positioned therein.

The first and second hinge joints, coupling the swing arms to the frame, may comprise a pin extending through a support tube coupled to the frame.

Each of the first and second swing arms may include a barrel portion including bushings positioned therein. The bushings may be positioned on the pin, an inner surface of the bushings and an outer surface of the pin may define an interface therebetween where the bushings may rotate relative to the pin.

In some embodiments, the barrel portion of the joint may include a grease fitting located thereon to facilitate the attachment of a grease gun for the insertion of the damping grease into the interface of joint. In further embodiments, a joint may not include a grease fitting and damping grease may be packed into the interface of the joint before the joint is fully assembled.

The damping grease positioned at the interface of at least one of the hinge joints and may be a grease having a relatively high viscosity. For example, the damping grease may have a dynamic viscosity greater than 100 Pascal seconds (Pa·s) at standard temperature and pressure (STP) (i.e., greater than about one kilopoise at STP). In some embodiments, the damping grease may comprise a synthetic hydrocarbon fluid base and a silica thickener and may have a dynamic viscosity of about 220 Pa·s at STP (i.e., about 2.2. kilopoise at STP). For example, damping grease sold under the tradename ROCOL® KILOPOISE 0868S, available from ROCOL of Leeds, England, may be a suitable damping grease.

The properties of the damping grease positioned at the interface of at least one joint of the exercise device between a first component (e.g., a bushing) and a second component (e.g., a pin) may resist the sudden movement (i.e., a relatively fast acceleration) of the first component of the joint relative to the second component of the joint. Accordingly, when a user steps onto a foot pad of the exercise device, the damping grease may prevent the foot pads, and other moving components such as the swing arms, from suddenly moving in response to the force applied by the user's foot. Rather, the foot pad may provide some resistance to the user's foot and the moving components may start to move relatively slowly. This may provide sufficient time for a user to gain their balance and react to the movement of the foot pads and swing arms as the user steps onto the exercise device.

Although the damping grease may provide resistance to relatively fast acceleration of the foot pads and swing arms, the damping grease may provide relatively low resistance to movement of the foot pads and swing arms that is associated with relatively slow acceleration, such as during normal exercise on the exercise device.

What is claimed is:

1. An exercise device comprising:

a frame;

a first foot support member connected to a central rotating member and including a central region mechanically constrained by a first joint to follow a first path;

a second foot support member connected to a central rotating member and including a central region mechanically constrained by a second joint to follow a second path;

wherein at least one of the first joint and the second joint includes an outer surface of a pin positioned adjacent to an inner surface of a bushing, the bushing being configured to move relative to the pin at an interface; and a damping grease between the pin and the bushing having a dynamic viscosity greater than about 100 Pascal seconds at standard temperature and pressure positioned at the interface between the pin and the bushing of the at least one joint.

2. The exercise device of claim 1, wherein the damping grease comprises a synthetic hydrocarbon fluid base.

3. The exercise device of claim 1, wherein the damping grease further comprises silica.

4. The exercise device of claim 1, wherein the damping grease has a dynamic viscosity of about 220 Pascal seconds at standard temperature and pressure.

5. The exercise device of claim 1, wherein the at least one joint is configured to bear at least a portion of a user's weight while exercising on the exercise device.

6. The exercise device of claim 1, further comprising:

a first swing arm coupled to a first side of an upper portion of the frame by a third joint, a first end of the first swing arm including a handle and a second end of the first swing arm coupled to the first foot support member via the first joint;

a second swing arm coupled to a second side of the upper portion of the frame by a fourth joint, a first end of the second swing arm including a handle and a second end of the second swing arm coupled to the second foot support member via the second joint.

7. The exercise device of claim 6, further comprising:

a drive assembly including a rotating member, a first crank arm extending from a first side of the rotating member, and a second crank arm extending from a second side of the rotating member;

wherein the first crank arm is coupled to the first foot support member by a fifth joint, and the second crank arm is coupled to the second foot support member by a sixth joint;

wherein the at least one joint further includes at least one of the fifth joint and the sixth joint.

8. The exercise device of claim 1, wherein the interface between the pin and the bushing of the at least one joint is shaped as a side surface of a cylinder.

9. The exercise device of claim 1, wherein the dampening grease is configured to resist a first sudden movement of the at least one joint and configured to reduce resistance to movement after the first sudden movement.

10. The exercise device of claim 1, further comprising a grease fitting disposed adjacent to the interface, wherein the grease fitting is configured to facilitate entry of the damping grease at the interface.

11. A method of manufacturing an exercise device, the method comprising:

providing a frame;

connecting a drive assembly to the frame;

providing a first foot support member connected to the drive assembly, wherein the first foot support member includes a central region mechanically constrained to follow a path;

providing a second foot support member connected to the drive assembly, wherein the second foot support member includes a central region mechanically constrained to follow a path;

positioning an outer surface of a pin of at least one of the first foot support member and the second foot support member adjacent to an inner surface of a bushing at an interface to form at least one joint;

positioning a damping grease having a dynamic viscosity greater than about 100 Pascal seconds at standard temperature and pressure at the interface between the pin and the bushing of the at least one joint.

12. The method of claim 11, wherein positioning the damping grease includes positioning a damping grease comprising a synthetic hydrocarbon fluid base.

13. The method of claim 12, wherein positioning the damping grease includes positioning a damping grease comprising silica.

14. The method of claim 11, wherein positioning the damping grease comprises positioning a damping grease having a dynamic viscosity of about 220 Pascal seconds at standard temperature and pressure.

15. The method of claim 11, wherein positioning the pin adjacent to the bushing to form the at least one joint comprises positioning the pin adjacent to the bushing to form at least one joint configured to bear at least a portion of a user's weight while exercising on the exercise device.

16. The method of claim 11, further comprising:

coupling a first swing arm having a first end including a handle to a first side of an upper portion of the frame by a first joint;

coupling a second end of the first swing arm to the first foot support member by a second joint;

coupling a second swing arm having a first end including a handle to a second side of an upper portion of the frame by a third joint;

coupling a second end of the second swing arm to the second foot support member by a fourth joint.

17. The method of claim 16, wherein positioning a damping grease having a dynamic viscosity greater than about 100 Pascal seconds at standard temperature and pressure at the interface between the pin and the bushing of the at least one joint comprises positioning the damping grease at an interface of the first joint and the third joint.

18. The method of claim 17, wherein positioning the damping grease at an interface of the first joint and the third joint further comprises positioning the damping grease at an interface of the second joint and the fourth joint.

19. The method of claim 16, further comprising:

providing the drive assembly including a rotating member, a first crank arm extending from a first side of the rotating member, and a second crank arm extending from a second side of the rotating member;

coupling the first foot support member to the first crank arm by a fifth joint;

coupling the second foot support member to the second crank arm by a sixth joint;

wherein positioning a damping grease having a dynamic viscosity greater than about 100 Pascal seconds at standard temperature and pressure at the at least one interface between the at least one pin and the at least one bushing of the at least one joint includes positioning the damping grease at an interface of the fifth joint and the sixth joint.

20. An exercise apparatus comprising:

a frame;

a drive assembly connected to the frame, wherein the drive assembly includes a first crank arm and a second crank arm;

a first foot support member coupled to the first crank arm of the drive assembly by a first joint;

a second foot support member coupled to the second crank arm of the drive assembly by a second joint;

the first joint and the second joint including an outer surface of a pin adjacent to an inner surface of a bushing; and a damping grease disposed in at least one of the first and second joint between the pin and the bushing, wherein the damping grease is configured to resist a first sudden movement of the at least one of the first and second joint and is further configured to reduce a resistance to movement after the first sudden movement.

* * * * *